US006322416B1

(12) United States Patent
Burke

(10) Patent No.: US 6,322,416 B1
(45) Date of Patent: Nov. 27, 2001

(54) PHOTOCHROMATIC TOY

(76) Inventor: Brian M. Burke, 1936 Arlington Ave., Columbus, OH (US) 43212

( * ) Notice: Subject to any disclaimer, the term of this patent is extended or adjusted under 35 U.S.C. 154(b) by 0 days.

(21) Appl. No.: 09/494,010

(22) Filed: Jan. 28, 2000

(51) Int. Cl.[7] ..... A63H 30/00
(52) U.S. Cl. ..... 446/175; 446/424; 446/427
(58) Field of Search ..... 446/3, 175, 424, 446/427, 435, 295, 219, 267; 40/427, 442, 443, 444

(56) References Cited

U.S. PATENT DOCUMENTS

| | | | | |
|---|---|---|---|---|
| 2,312,450 | | 3/1943 | Smith | 414/397 |
| 2,313,335 | | 3/1943 | Godfrey | 414/383 |
| 2,373,148 | | 4/1945 | Smith | 446/435 |
| 2,450,867 | | 10/1948 | Smith | 446/427 |
| 2,634,551 | | 4/1953 | Smith | 446/427 |
| 2,658,602 | | 11/1953 | Bonanno et al. | 198/582 |
| 2,660,001 | | 11/1953 | Smith et al. | 446/3 |
| 2,664,664 | | 1/1954 | Bonnano et al. | 446/137 |
| 2,973,604 | | 3/1961 | Digirolamo et al. | 446/3 |
| 4,917,643 | * | 4/1990 | Hippely et al. | 446/14 |
| 5,166,345 | * | 11/1992 | Akashi et al. | 544/71 |
| 5,208,132 | * | 5/1993 | Kamada et al. | 430/138 |
| 5,465,524 | * | 11/1995 | Vallone et al. | 43/42.32 |
| 5,743,185 | * | 4/1998 | Hippely et al. | 101/327 |

* cited by examiner

*Primary Examiner*—Kien T. Nguyen
(74) *Attorney, Agent, or Firm*—Baker & Daniels

(57) ABSTRACT

A toy system including a housing, an ultraviolet light source provided in the housing; and a representative element comprising photochromatic material, the representative element being temporarily disposed in the housing, the representative element being exposed to the ultraviolet light source while in the housing, the representative element having a first state in which a first condition is visually simulated and a second state in which a second condition is visually simulated, the first and second visually simulated conditions being different from one another. One of the first and second states is achieved in response to the representative element having been within the housing and exposed to the ultraviolet light source, whereby a corresponding one of the first and second conditions is simulated by the representative element having been within the housing. In one embodiment, the toy system may include a toy railway including a car which transports the representative element; the housing may be representative of a bottling plant and the representative element may represent a container such as a bottle, the visually simulated conditions being that the bottle is full or empty.

30 Claims, 4 Drawing Sheets

134
46
138
120
138
120
130
138
COLA
COLA
COLA

PHOTOCHROMATIC TOY

BACKGROUND OF THE INVENTION

1. Field of the Invention

The present invention relates to toys and toy systems which include photochromatic materials which change in appearance when subjected to ultraviolet (UV) light, and in particular to such toys and/or toy systems comprising movable cars, such as, for example, those included in model railways.

2. Background Art

Photochromatic materials are chemical compounds which exhibit a reversible change in its absorption spectrum upon irradiation with light of a given wavelength. Photochromatic compounds may be engineered to exhibit this change in the absorption spectrum at light wavelengths below those of visible light, the absorption spectrum change being manifested by a change in the color of the material. Thus, the material may exhibit one, "natural" color when exposed to visible light, and another, different color when exposed to light of a shorter wavelength.

Ultraviolet (UV) radiation is electromagnetic radiation in the part of the light spectrum between x-rays and visible light, and differs from visible light only in that the UV wavelengths are too short to be seen by the human eye. UV light has wavelengths which vary from between about 100 to 400 nm; the wavelength of visible light ranges from about 330 to 770 nm. UV light is generally characterized into three ranges: UVA (315 to 400 nm); UVB (280 to 315 nm); and UVC (200 to 280 nm). Light of wavelengths from 100 to 200 nm may also be considered to be a shorter range of UVC. UVB radiation, for example, is of the type used for suntanning, whereas UVC radiation may be used for germicidal disinfection; these types of light may be damaging to human cells. The well-known fluorescent or incandescent blacklight, however, emits UVA light radiation.

Many accessories which simulate activities related to rail transport are known and available for the model railroad hobbyist, and it is known to provide toy elements which represent various things which are transported by the model train. Such representative elements include, for example, people, animals, luggage, vehicles and other manufactured goods. Moreover, it is known to provide life-like miniature environments in which these elements are animated such that they may be moved about to simulate work being done by the people or on the goods.

Further, it is known to provide a model railroad accessory which comprises a representative element which simulates a container, such as a bottle. Previously, however, because the appearance of these representative elements have been substantially fixed, they have only simulated a single condition. For example, previous elements which represent bottles have been painted or molded in color, and thus may simulate only the containers' full or empty conditions. Separate, differently colored elements would be necessary to simulate the containers' empty condition.

A toy system, such as a model railway in combination with an accessory, in which a representative element may be altered in appearance to simulate a change in condition of thing it represents, without necessitating separate representative elements to simulate the separate conditions, is desirable. Further, it is desirable to provide a toy system in which a single representative element may be used to simulate both the presence and absence of something associated with the simulated element, which would, in the real world, be transported by rail. In particular, it is desirable to provide such a system in which the representative elements are separable from the train in which they are conveyed, and are animated during the time they are separated from the train.

SUMMARY OF THE INVENTION

An object of the present invention is to provide a toy system which includes photochromatic materials which change in appearance, for example, in color, when exposed to a source of UVA light, such as the well-known "black" light. The toy system includes a representative element, which models a real world element and which is temporarily changed in appearance to simulate a change in its condition as a result of having been exposed to the source of UVA light, or as a result of its having been received within a housing which contains the source of UVA light. The toy element may be altered in appearance in response to its exposure to the UVA light source to simulate the presence or absence of something associated with the real element. For example, the element represented may be a container such as a bottle, the condition simulated one of being substantially full. This simulated condition is temporarily achieved by exposure of the photochromatic material in the representative element to the source of UVA light. The altered state of appearance is temporary after such exposure, and the appearance of the representative element will eventually revert to a natural state once exposure to the UVA light source has ended. In its natural state of appearance, the toy bottle of the above example will simulate the condition of being substantially empty. Further, one embodiment of the present invention provides for representative elements which are separable from the train on which they are conveyed, and which are animated.

To achieve this object, the present invention provides a toy system including a housing, an ultraviolet light source provided in the housing, and a representative element comprising photochromatic material. The representative element is temporarily disposed in the housing and is exposed to the ultraviolet light source while in the housing. The representative element has a first state in which a first condition is visually simulated and a second state in which a second condition is visually simulated; the first and second visually simulated conditions are different from one another. One of the first and second states is achieved in response to the representative element having been within the housing and exposed to the ultraviolet light source, whereby a corresponding one of the first and second conditions is simulated by the representative element having been within the housing.

The present invention further provides a toy system including a movable toy car, a representative element which includes photochromatic material and which is transported by the car, and a housing within which the representative element is temporarily disposed. The housing includes a source of ultraviolet light to which the representative element is exposed while the representative element is disposed within the housing. The representative element has a first state of appearance in which a first condition is simulated, and a temporary second state of appearance different from the first state of appearance in which a second condition different from the first condition is simulated. The second state is in response to the representative element having been exposed to the source of ultraviolet light, the representative element being reverted to its first state of appearance when the representative element is no longer disposed within the housing.

The present invention further provides a toy including a housing in which is provided an ultraviolet light, and at least one photochromatic toy element which has first and second simulated conditions. The element is temporarily disposed in the housing and exposed to the ultraviolet light therein, whereby the color of the toy element is changed. A change between the conditions is simulated by the color change.

The present invention further provides a toy system which includes a representative element which includes photochromatic material, and has a first color and a second color, the first and second colors being different from each other. A first condition is simulated by the first color and a second condition simulated by the second color, the first and second conditions being different from each other. The system also includes a housing having a source of ultraviolet light attached thereto. The representative element and the source of ultraviolet light are selectively proximal to each other and in their selective proximity the representative element is exposed to ultraviolet light, whereby a change in color of the representative element from one of the first or second colors to the other is effected by the exposure.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1A:
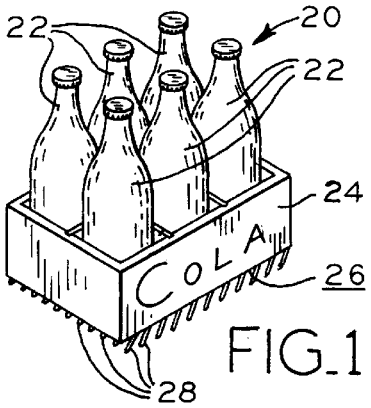
FIG. 1*a* is an upper perspective view of a first embodiment of a representative element according to the present invention, the representative element representing a carton of bottles.

Corresponding reference characters indicate corresponding parts throughout the several views. Although the drawings represent embodiments of the present invention, the drawings are not necessarily to scale and certain features may be exaggerated or simplified in order to better illustrate and explain the present invention. The exemplification set out herein illustrates an embodiment of the invention in alternative forms, and such exemplification is not to be construed as limiting the scope of the invention in any manner.

DETAILED DESCRIPTION OF THE INVENTION

Figure 1B:
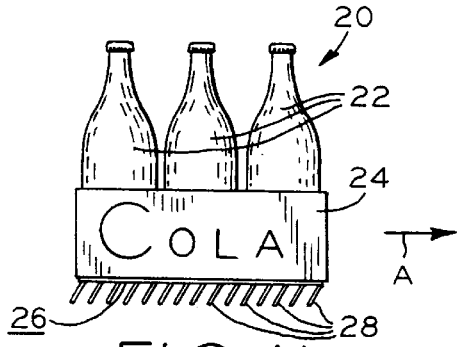
FIG. 1*b* is a side view of the representative element of FIG. 1*a;*
Figure 1C:
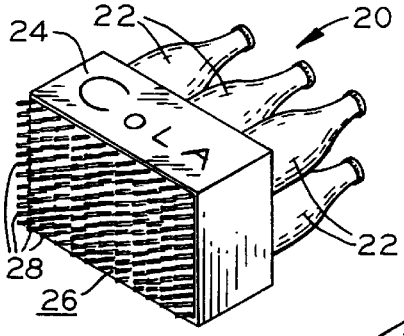
FIG. 1*c* is a lower perspective view of the representative element of FIG. 1*a;*

FIGS. 1*a* through 1*c* show a first embodiment of a representative element according to the present invention. Representative element 20 simulates a carton of soft drink bottles 22, although it is to be understood that the scope of the present invention is not intended to be limited to bottles, or even to containers. It will be appreciated that a representative element according to the present invention may simulate any of a variety of things, and use various photochromatic color changes as herein described to simulate a change in the condition of the represented thing as a result to being exposed to a source of ultraviolet light or having been within a housing in which such a source is located. Thus, a representative element according to the present invention may simulate, in its alternative states, various articles which have a first condition and a second, different condition. The first simulated condition may be, for example, the absence of "something" associated with the element represented, and the second simulated condition may be the presence of that something. In the depicted embodiment, the first simulated condition is one of the bottles being substantially empty of liquid and the second simulated condition being one of the bottles being substantially full of that liquid. Hence, in this example, the abovementioned "something" is the liquid which would be contained in an actual bottle.

The portion of representative element 20 which is shaped to represent bottles 22 is molded from a resin having a photochromatic concentrate therein. Suitable such resins include, for example, a high density polyethylene or a polypropylene; such resins are available from 2nd Story Concepts, 1922 26th Street, N.E., Canton, Ohio, 44705, and are there known as MASTER BATCH or M-BATCH™. Alternatively, this portion may be provided, by means of a dip or spray, with a photochromatic coating or film. Suitable such sprays include, for example, one which is also available from 2nd Story Concepts and which is there known as J-SPRAY. It is the portion of the representative element provided with a photochromatic material which changes color when exposed to UVA light, thereby simulating the bottles having been filled with a soft drink. Another portion of representative element 20 simulates carton or case 24 in which bottles 22 are disposed. Those skilled in the art will recognize that the bottles and the case may be simultaneously molded of a common material, or may be sequentially molded into an integrated, single unit, the case portion not including photochromatic material. The portion of representative element 20 which simulates the case also serves as base 24 for the element.

As mentioned above, bottles 22 have a first state which represents the condition of the bottles being substantially empty and a second state having a condition which represents the bottles being substantially full, the change from the first to the second state manifested by a color change. The second state is achieved in response to the photochromatic portion of element 20 being exposed to a source of UVA light, and is only a temporary state. The photochromatic material comprising bottles 22 will return to its "natural" state a short time after its exposure to the UVA light has ended. The first, or natural state of bottles 22 may be one in which they appear to be colorless, or a shade of white, gray or yellow, in the visible light spectrum, and in this state the bottles will appear to have the condition of being empty. In their first state, bottles 22 may also appear to be transparent or translucent.

When the bottles are exposed to a UVA light source, radiation from the source is be absorbed by the photochromatic material and a color change of the material will be effected. In this second state, the bottles may be shades of various colors, such as, for example, black, brown, green, orange, yellow or gray. In this state, the bottles may also be substantially opaque. The bottles thus will have a second state which represents a condition of the bottles being substantially full. The photochromatic material, when activated by UVA light, provides a color which substantially matches that of the simulated liquid which "fills" the bottle. For example, a cola drink may be black, and beer may be brown.

Extending from bottom surface 26 of case or base 24 is a plurality of parallel, resilient bristles or fingers 28 which are inclined towards the rear of the base. Representative element 20 is supported by fingers 28. It is well known in the pertinent art that when such fingers are in contact with a vibrating surface, motion of the representative element will be induced in the forward direction, opposite to that which the fingers are generally inclined. Thus, in response to vibration of the surface on which it rests, representative element 20 will be induced to move in the direction indicated by arrow A. Examples of representative elements having such means for inducing such directionally controlled movement in response to a vibratory input are disclosed in U.S. Pat. Nos. 2,660,001 (Smith et al.), and U.S. Pat. No. 2,973,604 (Digirolamo et al.), respectively issued Nov. 24, 1953 and Mar. 7, 1961, the disclosures of which are both expressly incorporated herein by reference.

Figure 2:
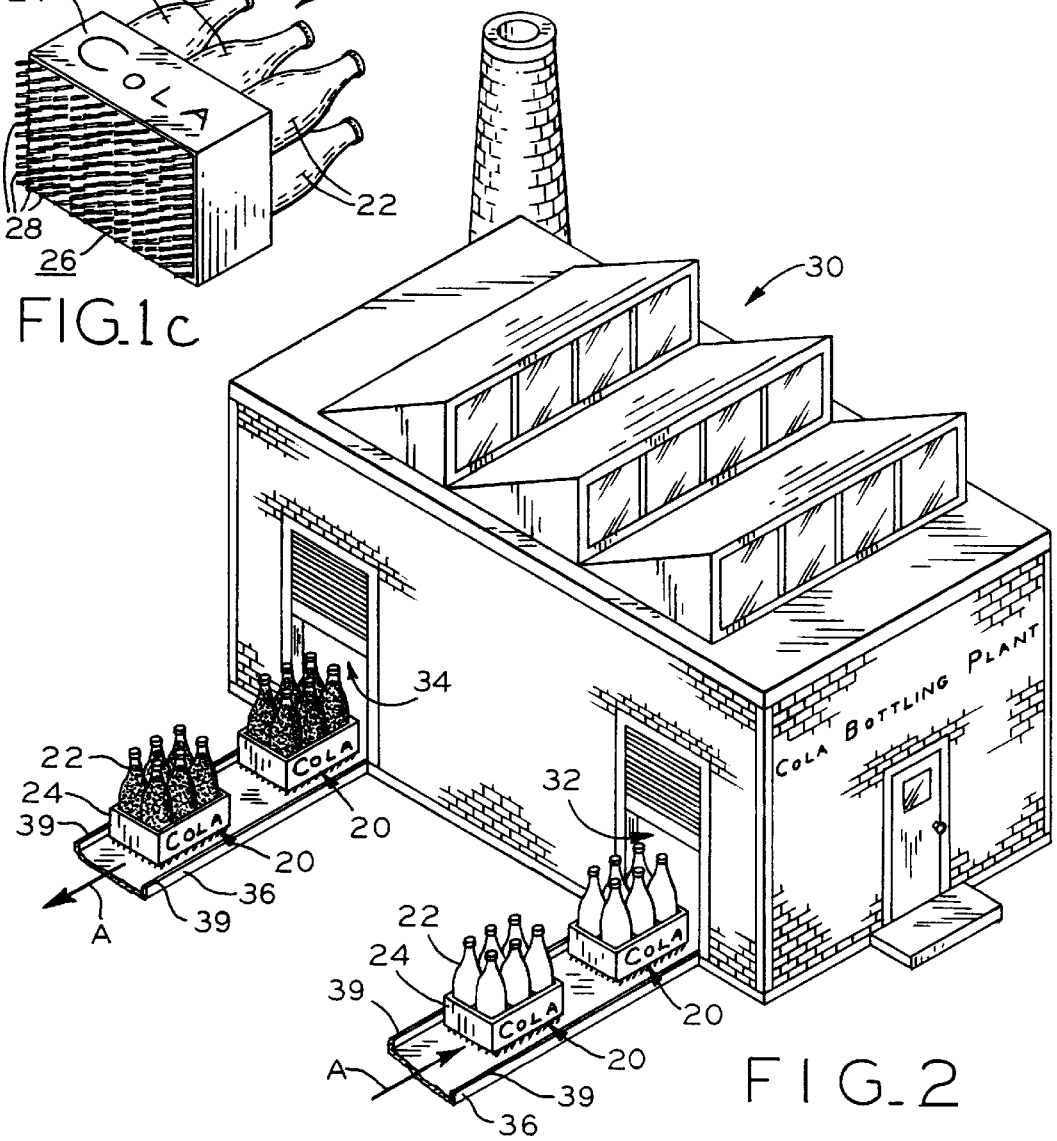
FIG. 2 is a perspective view of a first embodiment of a housing according to the present invention, the housing representative of a bottling plant building.

Referring now to FIG. 2 there is shown housing 30, an enclosure through which representative elements 20 are conveyed. Housing 30 represents a building; as depicted, this building is a bottling plant in which bottles 22 appear to be filled. It is to be understood that housing 30 need not be a structure which is substantially fully enclosing the representative elements, as shown; that aspect of depicted housing 30, however, lends itself to more suitable representation of a building. It is envisioned that a housing according to the present invention may be configured to merely provide a structure under or past which the representative elements are disposed or moved, and to which the UV lights are attached, as described below. Thus it is to be understood that the term "housing" as used herein encompasses any structure, fixed or moveable, which has a UV light source attached thereto, the light source temporarily placed in proximity to the representative element(s). The representative elements are exposed to the UV radiation and consequently experience a change in color.

Figure 3:
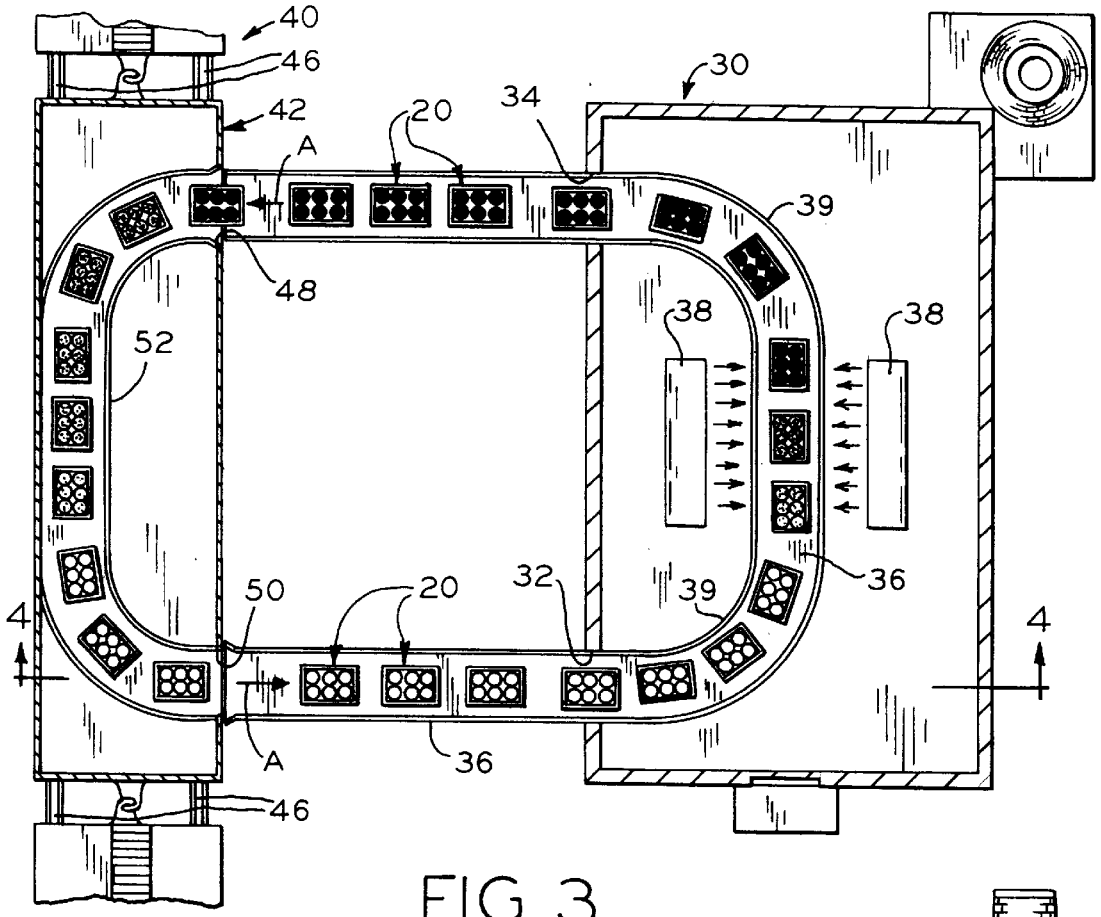
FIG. 3 is a sectional plan view of one embodiment of a toy system according to the present invention, this system including a plurality of representative elements as shown in FIG. 1, the housing of FIG. 2, and a toy railway car.

As shown in FIG. 3, U-shaped vibrating conveyor portion 36 extends from the train to entrance door 32 of housing 30, through the interior of the housing and from its exit door 34 back to the train. As best seen in FIG. 2, conveyor portion 36 may be provided with side shoulders 39 which help to guide the representative elements along the conveyor. Conveyor portion 36 is vibrated by any suitable, known means for inducing movement of such representative elements. Examples of such means are disclosed in U.S. Pat. Nos. 2,660,001 and 2,973,604.

Within housing 30, located above conveyor portion 36, are blacklights 38 which emit UVA light radiation onto representative elements 20 as they progress through housing on conveyor portion 36. Lights 38 may be either, or any combination of, the fluorescent tube type or the incandescent bulb type. In any known manner, lights 38 may be selectively activated by switching means (not shown) which will direct power to the UV lights in response to the sensed presence of a representative element within the housing. By this switching means, lights 38 are on only when the representative elements are being conveyed through the housing. Alternatively, lights 38 may be selectively manually activated or may remain on for extended periods.

Figure 4:
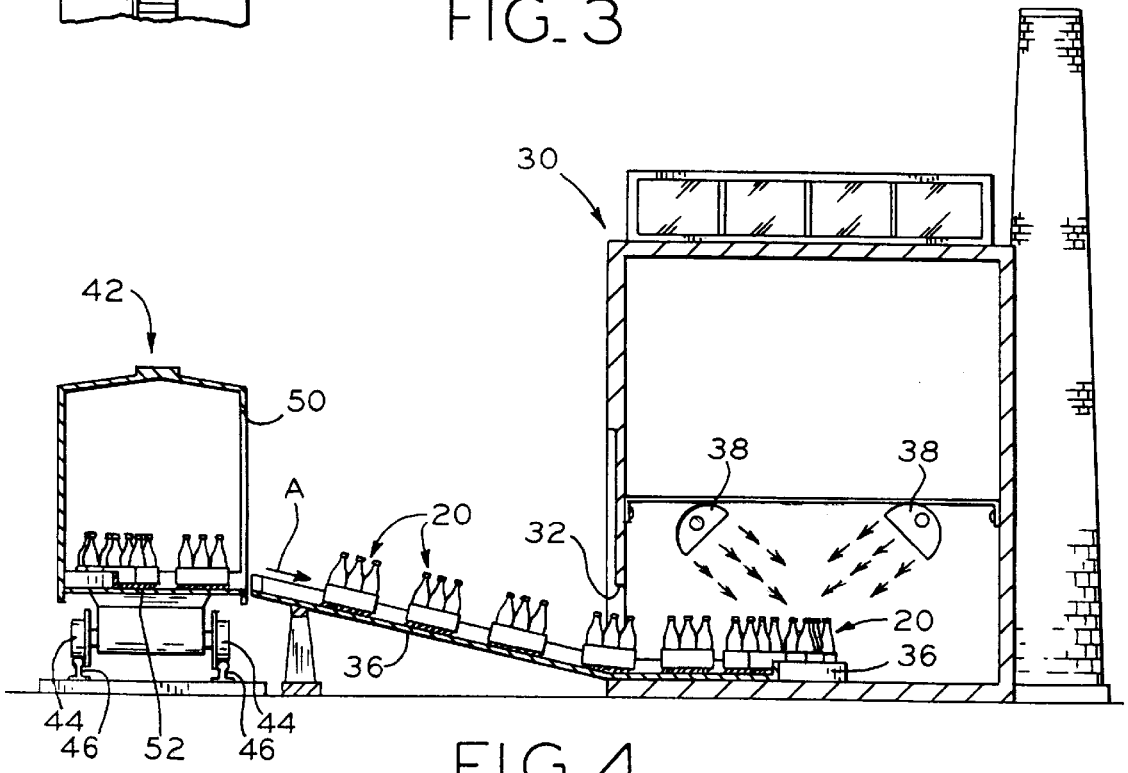
FIG. 4 is a view of the toy system of FIG. 3 along line 4—4.

FIGS. 3 and 4 show train 40 comprising car 42 having wheels 44 which roll along track 46. Car 42 is provided with loading doorway 48 which communicates with the beginning of conveyor portion 36 and unloading doorway 50 which communicates with the end of conveyor portion 36. Car 42 may be provided, at its doorways 48, 50, with automatically opening and closing doors (not shown) of any suitable type known in the art, such as those disclosed in U.S. Pat. No. 2,450,867 (Smith) issued Oct. 5, 1948, which is expressly incorporated herein by reference. Alternatively, doorways 48, 50 may be provided with doors which are manually opened and closed. It is to be understood that the inventive toy system which is a toy railway accessory is but an exemplary embodiment of the present invention. It is envisioned that the car on which the representative elements are conveyed need not be a railway car. Rather, certain unshown embodiments of the inventive toy system may include toy cars which are toy automobiles, trucks, trailers, wagons, and the like which are not moved along a track. Thus, the term "car" as used herein encompasses a variety of means by which the representative elements are conveyed.

Within car 42, extending between loading doorway 48 and unloading doorway 50 is conveyor portion 52 which is also provided with vibrating means such as disclosed in incorporated U.S. Pat. Nos. 2,660,001 or 2,973,604. In the known manner, the means for vibrating conveyor portion 52 within a railway car are actuated when car 42 is positioned along a section of track 46 in proximity to the station at which the bottles are unloaded and loaded. In this position, the beginning of conveyor portion 36 is aligned with the end of conveyor portion 52, and the end of conveyor portion 36 is aligned with the beginning of conveyor portion 52. Notably, car 42 can contain a plurality of representative elements 20 on conveyor portion 52 while the train is moving, and while the bottles are being conveyed along track 46 by car 42, the effect of the UV radiation on the photochromatic material wears off, and the bottles revert to their first, natural state.

With car 42 at the station where housing 30 is located, the unloading and loading doorways of the car are aligned with conveyor 36. The doors of car 42, if any, are opened and vibration of conveyor portions 36 and 52 commences. Representative elements 20 then move along conveyor portions 52 and 36 in the direction of arrow A, and the "empty" bottles (i.e., while elements 20 are in their first state) are unloaded from car 42. The empty bottles are transferred to bottling plant 30 along the conveyor, and therein are exposed to UVA radiation from lights 38.

After the bottles have been "filled" (i.e., after elements 20 have reached their second state), they are reloaded onto car 42. It is to be noted that if the door associated with unloading doorway 50 is closed after car 42 has been unloaded, the filled bottles subsequently loaded will abut along conveyor portion 52 and form a closely packed row of representative elements. Once car 42 is full, the door associated with loading doorway 48 may be closed, the conveyor vibrating means deactivated, and the train then leaves the station, where the bottling plant is located, along track 46. Notably, FIGS. 3 and 4 show conveyor portions 36 and 52 substantially full of representative elements 20, although it is envisioned that only so many elements will be provided to fill car 42. Further, FIGS. 2 and 3 show elements 20 in their first and second states, as well as in transition therebetween.

Figure 5:
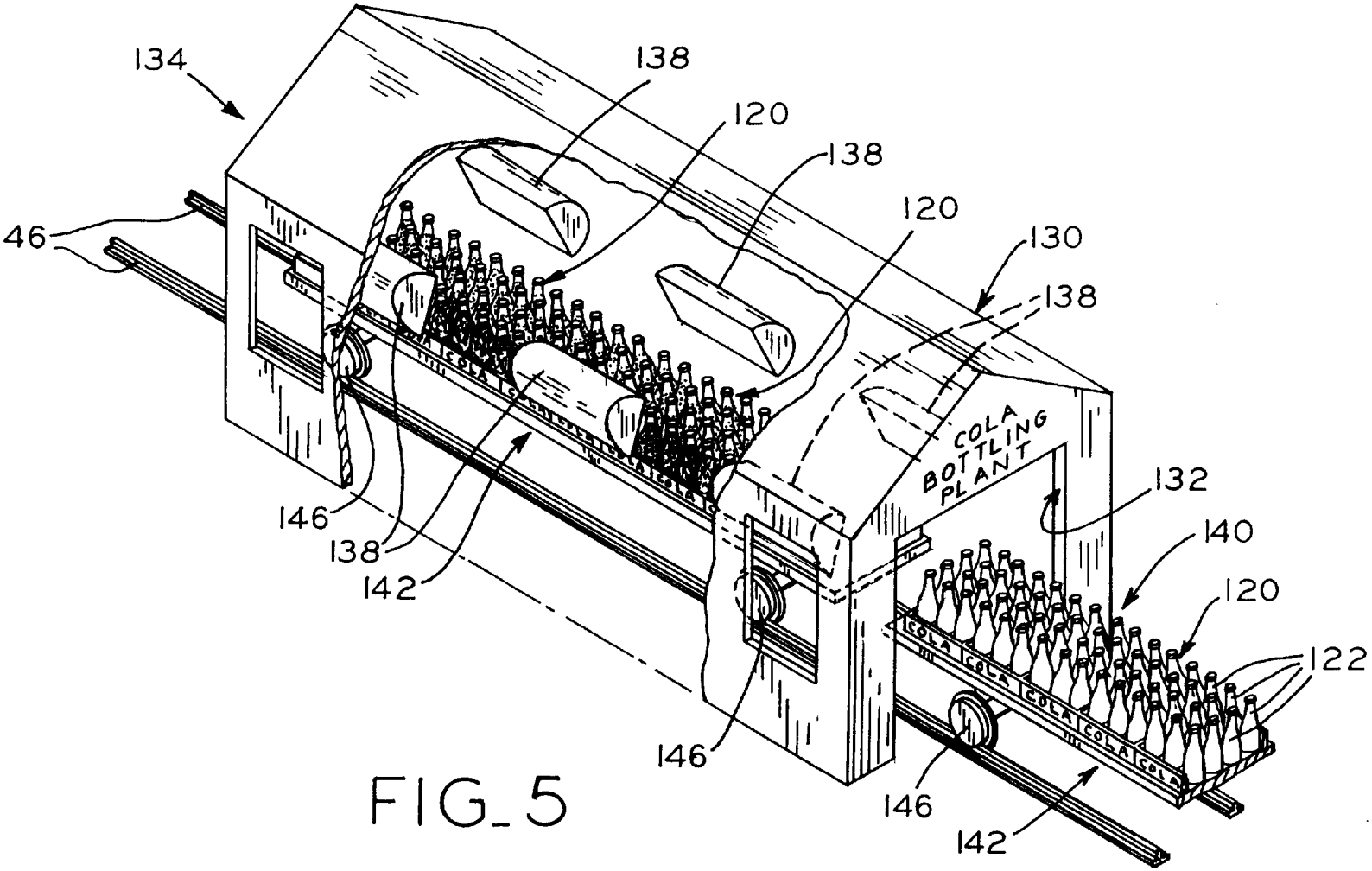
FIG. 5 is a perspective view of an alternative embodiment of a toy system according to the present invention, this system including second embodiments of a representative element and a housing according to the present invention, the housing again representative of a bottling plant building, a portion of which is broken away.

Referring now to FIG. 5, there is shown a second embodiment of a toy system according to the present invention. Housing 130, a second embodiment of a housing according to the present invention, again has the form of a cola bottling plant building, however in the embodiment shown in FIG. 5 the housing is disposed over a section of track 46; i.e., track 46 extends through housing 130 and train 140 enters housing 130 through its entrance door 132 and exits through its exit door 134. Representative elements 120 are carried on car 142 and remain on the car while they are exposed to UVA radiation emanating from blacklights 138. Lights 138 may be either, or any combination of, the fluorescent tube type or the incandescent bulb type. As in the above-described embodiment, switching means (not shown) may be provided to activate the lights as the train enters the housing, and to deactivate them as the train leaves. Alternatively, the lights may remain on for an extended period.

Bottles 122 simulate the condition of being empty as the train enters the bottling plant, and the condition of being filled when the train leaves the plant. Train 140 may temporarily stop while car 142 is disposed within housing 130, to allow time for sufficient exposure of bottles 122 to lights 138, or alternatively, the train may merely reduce its speed sufficiently to allow the representative elements to change from their first, natural state, to their second, colored state. Because it does not require offloading or animation of the representative elements, a toy system according to the second embodiment will be substantially less costly to produce than that of the first embodiment, although it will still provide a means for simulating different first and second conditions in the inventive manner. As mentioned above, the inventive toy system need not be a toy railway accessory, and the car need not be one which moves along a track. Rather, the representative elements may be conveyed by a car which is a toy automobile, truck, trailer, wagon or the like, and exposed to the UV light with the car itself disposed within, or brought into operative proximity with the UV lights of, the housing. Further, as mentioned above, it is to be understood that the housing need not be substantially fully enclosing of the representative elements, as shown in FIG. 5. Rather, the housing may be any structure to which the UV light is attached, and which allow the UV light to be placed in temporary proximity to the representative element, whereby its color is consequently changed.

Figure 6:
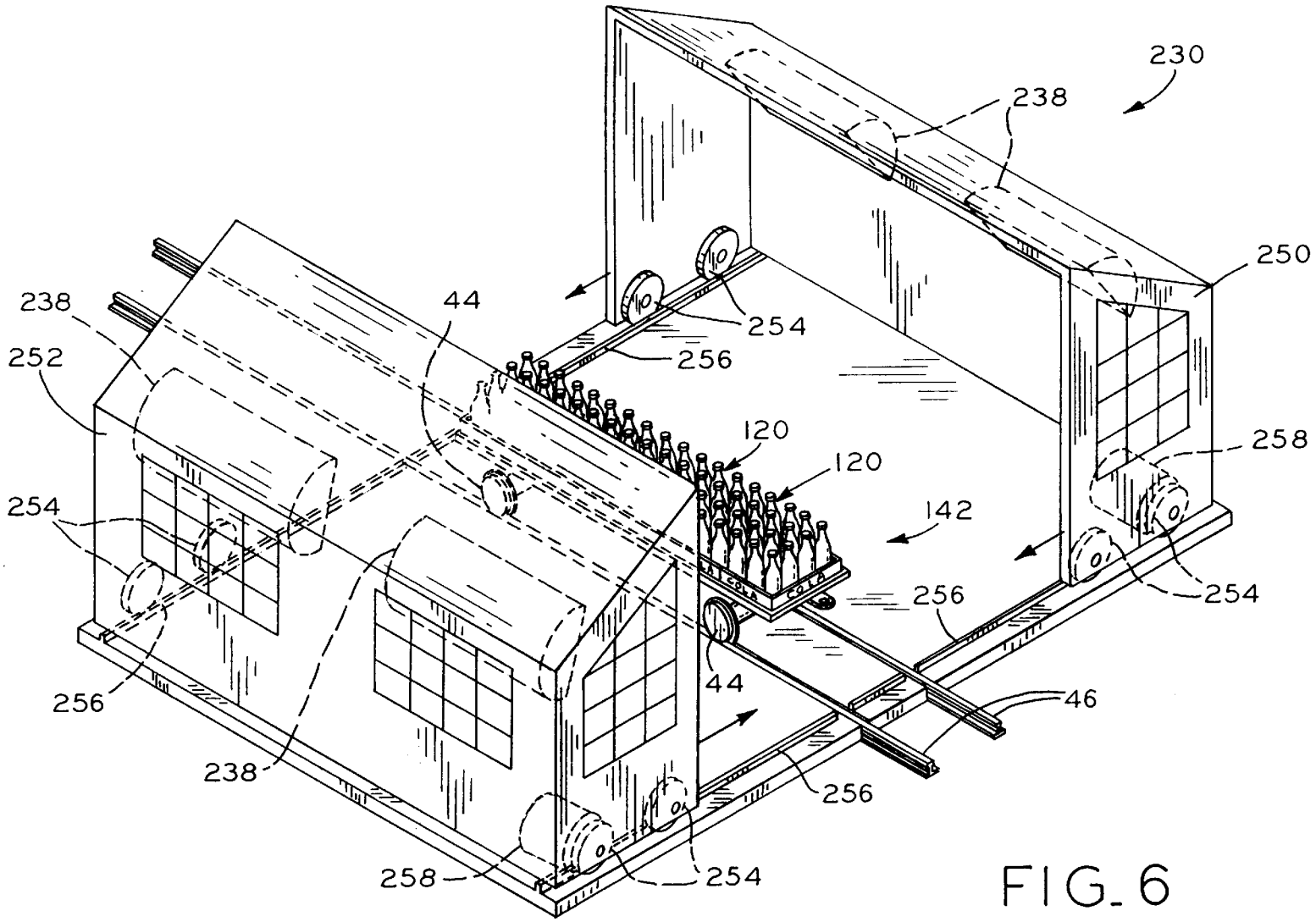
FIG. 6 is a perspective view of a further alternative embodiment of a toy system according to the present invention, this system including the representative element of FIG. 5, and a third embodiment of a housing according to the present invention.

Referring now to FIG. 6, there is shown a third embodiment of a housing according to the present invention. Unlike second embodiment housing 134 (FIG. 5) through which car 142 moves, third embodiment housing 230 according to the present invention moves about car 142. As shown in FIG. 6, housing 230 comprises separable first and second housing portions 250 and 252, respectively, within which blacklights 238 are attached. The first and second housing portions have rollers 254 rotatably attached thereto, and on these rollers the two housing portions advance toward and part away from each other on lateral tracks 256 which extend generally perpendicularly to railroad track 46, along which car 142 travels.

In the particular embodiment shown in FIG. 6, as train 140 (FIG. 5) approaches housing 230, housing parts 250 and 252 part, thereby allowing the train to pass therebetween on track 46. Car 142 may be disconnected from the remainder of the train and left alone on track 46 while the train moves away. The two housing portions may then advance toward each other on lateral tracks 256, and close about car 142. Once closed, lights 238 are energized, and representative elements 120 are exposed to UV radiation, causing a color change as described above. Notably, a roller 254 in each housing portion may be driven by a reversible electric motor 258 controlled in any suitable manner, thus automating the opening and closure of housing 230. Once representative elements 120 have been sufficiently exposed to UV radiation to effect their color change (i.e., bottles 120 have been "filled"), housing 230 again opens, with housing portions 250, 252 parting along lateral tracks 256, and car 142 is retrieved from the section of track 46 about which the housing closes. Car 142, with its complement of "full" bottles, is then coupled to train 140 and pulled along track 46 away from housing 230, which subsequently closes again. In any suitable, known manner, lights 238 may be selectively energized only when housing 230 is closed with car 142 inside. Further, as mentioned above, it is to be understood that the housing need not be substantially fully enclosing of the representative elements, or comprise two separable portions, as shown in FIG. 6. Rather, such a housing may be any structure to which the UV light is attached, and which is temporarily moved into proximity with a representative element including photochromatic material; for example, the housing may be a structure which approaches the representative elements from one side, without substantially enclosing them, and while the housing is in close proximity to the representative elements, they are exposed to UV light. Moreover, it is not necessary that the car carrying the representative be decoupled from the train, or even be a railway car; as mentioned above, the term "car" as used herein encompasses a variety of means by which the representative elements are conveyed.

While this invention has been described as having exemplary designs, the present invention may be further modified within the spirit and scope of this disclosure. This application is therefore intended to cover any variations, uses, or adaptations of the invention using its general principles. For example, the scope of the present invention is to be understood as encompassing toys other than those associated only with toy railways, or simulation of the presence or absence of something, e.g., a liquid in a bottle. For example, the scope of the present invention also encompasses toy ovens having a UVA light source therein, and a representative element which represents food to be baked or cooked and which has a first state in which a first, unbaked or uncooked condition is simulated, and a second state in which a second, baked or cooked condition is simulated. Further, this application is intended to cover such departures from the present disclosure as come within known or customary practice in the art to which this invention pertains.

What is claimed is:

1. A toy system comprising:

a housing;

an ultraviolet light source provided in said housing; and a representative element comprising photochromatic material, said representative element being temporarily disposed in said housing, said representative element being exposed to said ultraviolet light source while in said housing, said representative element having a first state in which a first condition is visually simulated and a second state in which a second condition is visually simulated, said first and second visually simulated conditions being different from one another;

wherein one of said first and second states is achieved in response to said representative element having been within said housing and exposed to said ultraviolet light source, whereby a corresponding one of said first and second conditions is simulated by said representative element having been within said housing.

2. The toy system of claim 1, wherein said housing is representative of a building.

3. The toy system of claim 2, wherein the building represented by said housing is a container filling plant and said representative element is representative of at least one container.

4. The toy system of claim 1, wherein at least a portion of said representative element is formed of a molded resin having a photochromatic concentrate therein.

5. The toy system of claim 1, wherein at least a portion of said representative element is provided with a photochromatic coating.

6. The toy system of claim 1, wherein said representative element represents at least one container, said first state of said representative element is being at least partially a first color, whereby said first simulated condition of said represented container is one of being substantially empty and being substantially full, and said second state of said representative element is being at least partially a second color, whereby said second simulated condition of said represented container is the other of being substantially empty and being substantially full.

7. The toy system of claim 6, wherein at least a portion of said representative element is, in its said first state, substantially translucent.

8. The toy system of claim 7, wherein said at least a portion of said representative element is, in its said second state, substantially opaque.

9. The toy system of claim 6, wherein one of said first and second colors is a shade of a color selected from the group consisting of black, brown, green, red, orange, yellow and gray.

10. The toy system of claim 1, wherein said system includes at least one movable car, and means for transferring at least one said representative element from said car to said housing, and means for transferring said at least one representative element from said housing to said car.

11. The toy system of claim 10, wherein said car comprises a train.

12. The toy system of claim 10, wherein each said means for transferring comprises vibrating means for inducing movement of said representative element.

13. The toy system of claim 12, wherein said vibrating means includes a conveyor along which said representative element moves, a portion of said conveyor extending through said housing.

14. The toy system of claim 13, wherein said conveyor portion is a first portion, and a second portion of said conveyor extends through said car.

15. The toy system of claim 12, wherein said vibrating means includes a portion of said car.

16. The toy system of claim 12, wherein said representative element comprises a base on which are provided a plurality of resilient fingers on which said representative element is supported, said transferring means comprising said fingers.

17. The toy system of claim 1, further comprising said representative element being moveable into said housing from a location outside of said housing.

18. The toy system of claim 1, further comprising said housing being moveable to an at least partially enclosed position about said representative element.

19. The toy system of claim 1, wherein said system includes a toy railway including a moveable car, and a track on which said car is disposed and along which said car moves, a said representative element disposed on said car, and wherein a section of said track extends into said housing, whereby said representative element is exposed to said ultraviolet light source when said car is disposed on said section of track and within said housing.

20. The toy system of claim 19, wherein said section of track extends completely through said housing.

21. A toy system comprising:

a movable toy car;

a representative element which includes photochromatic material and which is transported by said car; and a housing within which said representative element is temporarily disposed, said housing including a source of ultraviolet light to which said representative element is exposed while said representative element is disposed within said housing;

wherein said representative element has a first state of appearance in which a first condition is simulated, and a temporary second state of appearance different from said first state of appearance in which a second condition different from said first condition is simulated, said second state being in response to said representative element having been exposed to said source of ultraviolet light, said representative element being reverted to its said first state of appearance when said representative element is no longer disposed within said housing.

22. The toy system of claim 21, wherein said first state of appearance includes at least a portion of said representative element being a first color, and said second state of appearance includes said portion of said representative element being a second color different from said first color.

23. The toy system of claim 21, wherein said housing is representative of a building.

24. The toy system of claim 23, wherein said car is received within said housing.

25. The toy system of claim 23, wherein said representative element is separable from said car, and further comprising means for transferring said representative element from said car and into said housing and for transferring said representative element from said housing to said car.

26. The toy system of claim 25, wherein said means for transferring includes a conveyor.

27. The toy system of claim 26, wherein said means for transferring further comprises means for vibrating said conveyor.

28. The toy system of claim 21, wherein said toy car is a toy railway car.

29. A toy comprising a housing, an ultraviolet light provided in said housing, and at least one photochromatic toy element which has first and second simulated conditions, said element being temporarily disposed in said housing and exposed to said ultraviolet light, whereby the color of said toy element is changed, wherein a change between said conditions is simulated by the color change.

30. A toy system comprising:

a representative element comprising photochromatic material, and having a first color and a second color, said first and second colors being different from each other, a first condition simulated by said first color and a second condition simulated by said second color, said first and second conditions being different from each other; and a housing having a source of ultraviolet light attached thereto;

said representative element and said source of ultraviolet light being selectively proximal to each other and in said selective proximity said representative element being exposed to ultraviolet light, whereby a change in color of said representative element from one of said first and second colors to the other of said first and second colors is effected by said exposure.

* * * * *